US008550784B2

(12) United States Patent
Malmborg et al.

(10) Patent No.: US 8,550,784 B2
(45) Date of Patent: Oct. 8, 2013

(54) GAS TURBINE ENGINE ROTOR CONSTRUCTION

(75) Inventors: Eric W. Malmborg, Amston, CT (US); Matthew E. Bintz, West Hartford, CT (US)

(73) Assignee: United Technologies Corporation, Hartford, CT (US)

( * ) Notice: Subject to any disclaimer, the term of this patent is extended or adjusted under 35 U.S.C. 154(b) by 69 days.

(21) Appl. No.: 13/100,812

(22) Filed: May 4, 2011

(65) Prior Publication Data

US 2012/0282101 A1 Nov. 8, 2012

(51) Int. Cl.
*F01D 5/06* (2006.01)

(52) U.S. Cl.
USPC ..... 416/198 A; 415/199.5

(58) Field of Classification Search
USPC ..... 415/198.1, 199.4, 199.5; 416/198 R, 416/198 A, 214 A, 244 A
See application file for complete search history.

(56) References Cited

U.S. PATENT DOCUMENTS 2,452,782 A * 11/1948 McLeod et al. ..... 416/201 R
2,640,679 A * 6/1953 Wheatley et al. ..... 415/209.4
2,654,565 A * 10/1953 Feilden ..... 416/201 R
3,807,895 A * 4/1974 McMurtry ..... 415/199.5
5,232,339 A 8/1993 Plemmons et al.
5,361,580 A 11/1994 Ciokajlo et al.
5,558,496 A * 9/1996 Woodmansee et al. ..... 416/95
7,309,210 B2 12/2007 Suciu et al.
7,322,101 B2 1/2008 Suciu et al.
7,811,053 B2 10/2010 Balamucki et al.
7,836,596 B2 11/2010 Suciu et al.
8,287,242 B2 * 10/2012 Bifulco ..... 416/244 A
2005/0232774 A1 * 10/2005 Suciu et al. ..... 416/198 A
2009/0016886 A1 * 1/2009 Pichel ..... 416/198 A
2010/0124495 A1 5/2010 Bifulco
2010/0158699 A1 6/2010 Makuszewski
2010/0239424 A1 9/2010 Maalouf et al.
2010/0266401 A1 10/2010 Bintz et al.

* cited by examiner

*Primary Examiner* — Edward Look
*Assistant Examiner* — Liam McDowell
(74) *Attorney, Agent, or Firm* — O'Shea Getz P.C.

(57) ABSTRACT

A longitudinal stack of gas turbine engine rotor disks each include an annular spacer which transmits compressive pre-loading of the stack to an adjacent disk, the spacer and an annular shoulder on the disk rim defining an annular slot which accommodates the base of a segmented annular blade cluster which shields the rim from some of the heat associated with the flow of working fluid around the disks.

12 Claims, 1 Drawing Sheet

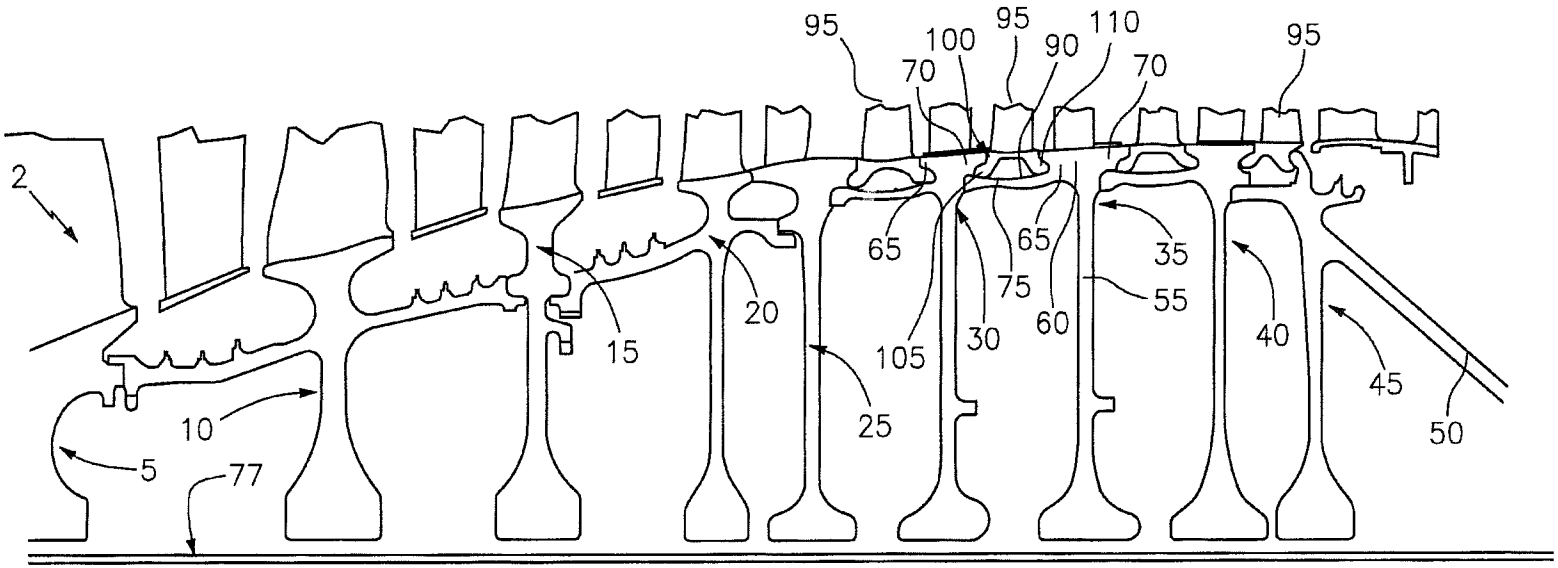
95
110
70
90
95
100
70
95
50
45
40
35
55
65
60
75
30
105
65
25
20
15
10
77
5
2

GAS TURBINE ENGINE ROTOR CONSTRUCTION

BACKGROUND OF THE INVENTION

1. Technical Field

This invention relates generally to gas turbine engines and particularly to a gas turbine engine rotor construction.

2. Background Information

Gas turbine engines, such as those which power aircraft and industrial equipment, employ a compressor to compress air which is drawn into the engine and a turbine to capture energy associated with the combustion of a fuel-air mixture which is exhausted from the engine's combustor. The compressor and turbine employ rotors which typically comprise a multiplicity of airfoil blades mounted on, or formed integrally into the rims of a plurality of disks. The compressor disks and blades are rotationally driven by rotation of the engine's turbine. It is a well-known prior art practice to arrange the disks in a longitudinally axial stack in compressive interengagement with one another which is maintained by a tie shaft which runs through aligned central bores in the disks. It is a common practice to arrange the disks so that they abut one another in the aforementioned axial stack along side edges of the disk rims. The disk rims are exposed to working fluid flowing through the engine and therefore are exposed to extreme heating from such working fluid. For example, in a gas turbine engine high pressure compressor, the rims of the disks are exposed to highly compressed air at a highly elevated temperature. The exposure of disk rims to such elevated temperatures, combined with repeated acceleration and deceleration of the disks resulting from the normal operation of the gas turbine engine at varying speeds and thrust levels may cause the disk rims to experience low cycle fatigue, creep and possibly cracking or other structural damage as a result thereof. This risk of structural damage is compounded by discontinuities inherent in the mounting of the blades on the rims. Such discontinuities may take the form of axial slots provided in the rims to accommodate the roots of the blades or, in the case of integrally bladed rotors wherein the blades are formed integrally with the disks, the integral attachment of the blades to the disks. Such discontinuities result in high mechanical stress concentrations at the locations thereof in the disks, which intensify the risks of structural damage to the disk rims resulting from the low cycle fatigue and creep collectively referred to as thermal mechanical fatigue, experienced by the disks as noted hereinabove. Moreover, the high compressive forces along the edges of the disk rims due to the mutual abutment thereof in the aforementioned preloaded compressive retention of the disks in an axial stack further exacerbates the risk of structural damage to the disk rims due to the aforementioned low cycle fatigue and creep.

Therefore, it will be appreciated that minimization of the risk of disk damage due to thermal-mechanical fatigue, and stress concentrations resulting from discontinuities in the disk rim is highly desirable.

SUMMARY OF THE DISCLOSURE

In accordance with the present invention, a gas turbine engine rotor comprising a plurality of blade supporting disks adapted for longitudinal compressive interengagement with one another includes at least one disk comprising a medial web and an annular rim disposed at a radially outer portion of the web, the rim including longitudinally extending annular shoulders and further comprising an annular spacer extending longitudinally from the disk proximal to the juncture of the web and rim, and being spaced radially inwardly from one of the shoulders for abutment at a free edge of the spacer with an adjacent disk for transmission of compressive preloading force from the one disk to the adjacent disk, the spacer and the one shoulder defining an annular slot in which a base of a segmented annular blade cluster is received. The spacer allows the compressive preloading of the disks to be transmitted therebetween radially inwardly of the disk rim so as to not exacerbate thermal mechanical rim fatigue. The blade cluster thermally shields the rim from at least a portion of the destructive heating thereof by working fluid flowing through the engine.

BRIEF DESCRIPTION OF THE DRAWINGS

FIG. 1 is a side elevation of the gas turbine engine rotor of the present invention as employed in a compressor section of the gas turbine engine.

DETAILED DESCRIPTION OF THE INVENTION

Referring to FIG. 1, a gas turbine engine rotor 2 comprises a plurality of rotatable blade supporting disks 5, 10, 15, 20, 25, 30, 35, 40 and 45 which are disposed in a longitudinal axial stack within a hub, the rear portion of which is shown at 50 in longitudinal compressive interengagement with one another, the rear portion of the hub and a forward portion thereof (not shown) clamping the disks together with a suitable compressive preload to accommodate axial loading of the disks by working fluid flowing through the engine. As shown in FIG. 1, the disks comprise compressor disks, although the rotor structure of the present invention may also be employed in other sections of the gas turbine engine such as a turbine section thereof.

Still referring to FIG. 1, the disks, as exemplified by disk 35, each include a medial web 55 and an annular rim 60 disposed at a radially outer portion of the web. Rim 60 includes longitudinally extending annular shoulders 65 and 70. Disk 35 also includes an annular spacer 75 extending longitudinally from the disk proximal to the juncture of the web and the rim and spaced radially inwardly from shoulder 65 of rim 60. The free edge of annular spacer 75 abuts adjacent disk 30 for the transmission of a compressive preloading force applied to the disk stack by forward and aft portions of the hub. The compressive preloaded engagement of the disks with one another is maintained by the tie shaft 77 which extends through aligned central bores in the disks and preserves the structural integrity of the stack for torque transmission therethrough, tie shaft 77 applying the compressive preloading of the disk stack by way of the engagement of the tie shaft with the hub. As shown, spacer 75 engages disk 30 proximal to the juncture of the rim and web of that disk. Spacer 75 is catenary in cross-sectional shape so that spacer 75 may function as a compression spring to preserve the compressive preloaded engagement of disk 35 against disk 30. Spacer 75 includes a radially outer surface thereon, the outer surface of spacer 75 and a radially inner surface of shoulder 65 defining a first annular slot 90. The blades of compressor rotor are provided in the form of an annular cluster comprising a plurality of individual blades 95 extending radially outwardly from a segmented annular base 100 which includes at opposite forward and aft edges thereof a pair of annular feet 105 and 110 which are received within a slot 90 defined by the shoulders of the rims of disks 30 and 35 and spacer 75. The radial axes (stacking lines) of the blades are disposed between the adjacent disks which support each cluster.

As set forth hereinabove, the catenary shape of spacer 75 causes the spacer to act as a compression spring for preservation of the compressive preload of each disk against an adjacent disk for effective torque transmission therebetween. Since disk compressive preloading forces are transmitted through the spacers, the disk rims which experience severe thermal loading from the heat of the working fluid are not subjected to the compressive preloading forces which would otherwise exacerbate the thermal mechanical fatigue discussed hereinabove which the disk rims experience from the high temperature working fluid flowing therearound. The blade clusters themselves provide some insulative properties, thereby protecting the disk rims from heat carried by the working fluid flowing past the rotor. The segmented nature of the annular blade cluster bases reduces hoop stress therein from levels thereof which would be inherent in full, annular blade clusters. The definition of slots 90 by the rim shoulders and spacers eliminate the need for the formation of slots directly in the disk rims to accommodate individual blade roots. As set forth hereinabove, stress concentrations associated with such individual slots would otherwise exacerbate the thermal-mechanical fatigue associated with low cycle rim fatigue and creep. Furthermore, since individual blade slots are not necessary with the present invention, the disk rim portions may be efficiently and economically coated with any appropriate thermal barrier coating such as zirconium oxide or the like. Further disk stress reduction is achieved by the retention of the blade clusters by the rim shoulders which are more compliant than that portion of the disk rim which is in radial alignment with the disk web.

While a specific embodiment of the present invention has been shown and described herein, it will be understood that various modification of this embodiment may suggest themselves to those skilled in the art. For example, while the gas turbine engine rotor of the present invention has been described within the context of a high pressure compressor rotor, it will be appreciated that invention hereof may be equally well-suited for turbine rotors as well. Also, while specific geometries of portions of the disks and blade clusters have been illustrated and described, it will be appreciated that various modifications to these geometries may be employed without departure from the present invention. Similarly, while a specific number of compressor disks have been shown and described, it will be appreciated that the rotor structure of the present invention may be employed in rotors with any number of blade supporting disks. Accordingly, it will be understood that these and various other modifications of the preferred embodiment of the present invention as illustrated and described herein may be implemented without departing from the present invention and is intended by the appended claims to cover these and any other such modifications which fall within the true spirit and scope of the invention herein.

Having thus described the invention, what is claimed is:

1. In a gas turbine engine rotor comprising a plurality of rotatable blade supporting disks adapted for retention by longitudinal compressive interengagement with one another, at least one disk comprising a medial web and an annular rim disposed at a radially outer portion of said web;

said annular rim having longitudinally extending annular shoulders including radially inner and outer annular surfaces thereon;

said one disk further including an annular spacer extending longitudinally from said one disk proximal to a juncture of said web and said rim and being spaced radially inwardly from one of said rim shoulders for abutment at a free edge thereof with an adjacent disk for transmission of compressive preloading force and torque transmission between said one disk and said adjacent disk;

an airfoil blade cluster comprising a plurality of airfoil rotor blades extending radially outwardly from a segmented annular base;

said radially inner surface of said one shoulder of said rim of said one disk and a radially outer surface of said spacer defining in part, a first annular slot, said segmented annular base of said airfoil blade cluster being at least partially received in said first annular slot.

2. The gas turbine engine rotor of claim 1, wherein said adjacent disk comprises a medial web and an annular rim disposed at a radially outer portion thereof, said annular rim of said adjacent disk having longitudinally extending shoulders including radially inner and outer annular surfaces thereon, said first annular slot being further defined by said radially outer surface of said said annular spacer and said radially inner surface of one of said shoulders of said adjacent disk.

3. The gas turbine engine rotor of claim 2, wherein said annular spacer of said one disk is in radial alignment with a location proximal to a juncture of said web and rim of said adjacent disk.

4. The gas turbine engine rotor of claim 2, wherein said annular rim of said adjacent disk comprises longitudinally extending annular shoulders including radially inner and outer annular surfaces thereon.

5. The gas turbine engine rotor of claim 1, wherein said annular spaces is catenary in cross-sectional shape.

6. The gas turbine engine rotor of claim 1, wherein said segmented annular base of said airfoil blade cluster includes forward and aft edges, each of said forward and aft edges comprising an annular foot extending longitudinally outwardly from a corresponding edge of said blade cluster base, said first annular slot in said one disk accommodating one of said blade cluster feet therewithin.

7. The gas turbine engine rotor of claim 1, wherein said disks comprise compressor disks and said airfoil rotor blades comprise compressor blades.

8. The gas turbine engine rotor of claim 7, wherein said disks comprise high pressure compressor disks and said airfoil rotor blades comprise high pressure compressor blades.

9. The gas turbine engine rotor of claim 1, wherein the radial axes of said airfoil rotor blades are longitudinally disposed between said one disk and said adjacent disk.

10. The gas turbine engine of claim 1, wherein said disks comprise respective bores at central locations thereof, said bores accommodating a tie shaft for maintaining said longitudinal compressive interengagement of said disks.

11. The gas turbine engine rotor of claim 1, wherein said disks are disposed within a hub, said one disk being integral with an aft end portion of said hub.

12. The gas turbine engine rotor of claim 11, wherein said aft end portion of said hub is generally conically shaped.

* * * * *